US006926533B2

(12) United States Patent
Lai

(10) Patent No.: US 6,926,533 B2
(45) Date of Patent: Aug. 9, 2005

(54) ALL-DIRECTIONAL ELECTRIC CONNECTOR

(76) Inventor: Wen Ching Lai, 9-47 Ho Hsing, Ho Hsing Village, Hu-Kou, Hsinchu Hsien (TW)

( * ) Notice: Subject to any disclaimer, the term of this patent is extended or adjusted under 35 U.S.C. 154(b) by 0 days.

(21) Appl. No.: 10/462,590

(22) Filed: Jun. 17, 2003

(65) Prior Publication Data

US 2004/0259390 A1 Dec. 23, 2004

(51) Int. Cl.[7] ..... H01R 39/00
(52) U.S. Cl. ..... 439/23
(58) Field of Search ..... 439/13, 18, 20, 439/21, 23–26

(56) References Cited

U.S. PATENT DOCUMENTS 6,093,028 A * 7/2000 Yang ..... 439/13
6,576,852 B1 * 6/2003 Shu ..... 200/51 R
6,579,333 B2 * 6/2003 Huang ..... 55/385.1

* cited by examiner

*Primary Examiner*—Gary Paumen

(57) ABSTRACT

An all-directional electric connector includes rotatably connected first and second casings. First and second pins are projected from a rear wall of the first casing and respectively have a front end in the form of a cylindrical tube. The first cylindrical tube is put on a cylindrical bar extended from the first casing into the second casing, a sleeve is put on the first cylindrical tube, and the second cylindrical tube is put on the sleeve without contacting with the first cylindrical tube. First and second leaf springs are provided in the second casing with one end contacted with the first and second cylindrical tubes, respectively, and the other end forming two contacts. When the first casing is plugged in a wall receptacle, the second casing may be turned relative to the first casing without causing disconnection of the leaf springs from the cylindrical tubes.

10 Claims, 10 Drawing Sheets

ALL-DIRECTIONAL ELECTRIC CONNECTOR

FIELD OF THE INVENTION

The present invention relates to an electric connector, and more particularly to an electric connector having a first part adapted to fixedly plug in a wall-mount commercial power receptacle and a second part adapted to turn relative to the first part to set a power cord connected thereto to a desired position without causing undesired disconnection of power supply.

BACKGROUND OF THE INVENTION

A conventional mini dim light has a lamp holder that may be rotated and thereby adjusted to different angular positions relative to a wall receptacle. To this effect, two pins on the mini dim light for plugged in pin slots on the wall receptacle are connected to two concentric annular conductive plates having different diameters, and two conductive leaf springs in the lamp holder have extended length and two projected portion formed on two tree ends thereof, such that the projected portions may separately slide on the two concentric annular plates. When the projected portions on the free ends of the conductive leaf springs are slid into two recesses on the concentric annular plates, the lamp holder is stably electrically connected to the pins.

In the above structure to enable a rotatable lamp holder, since the concentric annular plates occupy a considerable volume, the structure is only suitable for a mini dim light without being used in other types of lighting fixtures. Moreover, since the leaf springs of the lamp holder slid over the annular plates must engage with the recesses on the annular plates to enable electric connection of the leaf springs to the pins, this type of rotatable mini dim light is stably made only at some particular angular positions. In other words, such conventional mini dim light is not workable at all angular positions. Instead, it is only workable in some specific directions.

There might be two or three pin slots on each socket on a wall receptacle. Power may be output from an external power source to an electrical appliance or a receptacle connected to an extension cord only when a plug connected to the appliance or the receptacle having at least two conductive pins is plugged in the socket on the wall receptacle. Once the plug is plugged in the socket, the at least two pins together fix the plug to a fixed direction, making the whole plug non-rotatable relative to the wall receptacle. As a result, a power cord extended behind the plug tends to become twisted or exert a pull force to damage the plug.

There are simple electric appliances, such as a mini dim light, which do not have a power cord connected thereto or a rotatable structure. When such an electric appliance is plugged in a wall receptacle that has pin slots arranged in an undesired direction, the appliance would be connected to the wall receptacle in a lying or an inverted position to cause inconvenience in use.

SUMMARY OF THE INVENTION

A primary object of the present invention is to provide an all-directional electric connector that includes a first casing fixedly plugged in a wall receptacle and a second casing rotatably connected to the first casing. Conductive leaf springs provided in the second casing are connected to metal conductors of a power cord, so that the connector may serve as a plug and the power cord extended behind it would not be undesirably twisted.

Another object of the present invention is to provide an all-directional electric connector that includes a first casing fixedly plugged in a wall receptacle and a second casing rotatably connected to the first casing. The second casing has a lamp holder provided thereon. Conductive leaf springs provided in the second casing are extended into the lamp holder to contact with a lamp bulb mounted on the lamp holder and thereby makes the lamp bulb.

A further object of the present invention is to provide an all-directional electric connector that includes a first casing fixedly plugged in a wall receptacle and a second casing rotatably connected to the first casing. The second casing is in the form of a receptacle having a plurality of sockets provided thereon. Conductive leaf springs provided in the second casing are electrically connected to two electrodes in the receptacle.

To achieve the above and other objects, the all-directional electric connector according to the present invention mainly includes a first casing and a second casing rotatably connected to a rear end of the first casing. First and second pins are projected from a rear wall of the first casing and respectively have an inner end in the form of a cylindrical tube. The first cylindrical tube is put on a cylindrical bar extended from the rear wall of the first casing toward the second casing, a sleeve is put on the first cylindrical tube, and the second cylindrical tube is put on the sleeve to separate from the first cylindrical tube. First and second leaf springs are provided in the second casing with one end in contact with the first and second cylindrical tubes, respectively, and the. other end forming two contacts. Thus, when the first casing is plugged in a wall receptacle, the second casing may be turned by any angle without causing disconnection of the leaf springs from the cylindrical tubes.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Please refer to FIGS. 1 to 4 in which an all-directional electric connector according to a first embodiment of the present invention is shown. The all-directional electric connector includes a first part and a second part in front of the first part.

Figure 1:
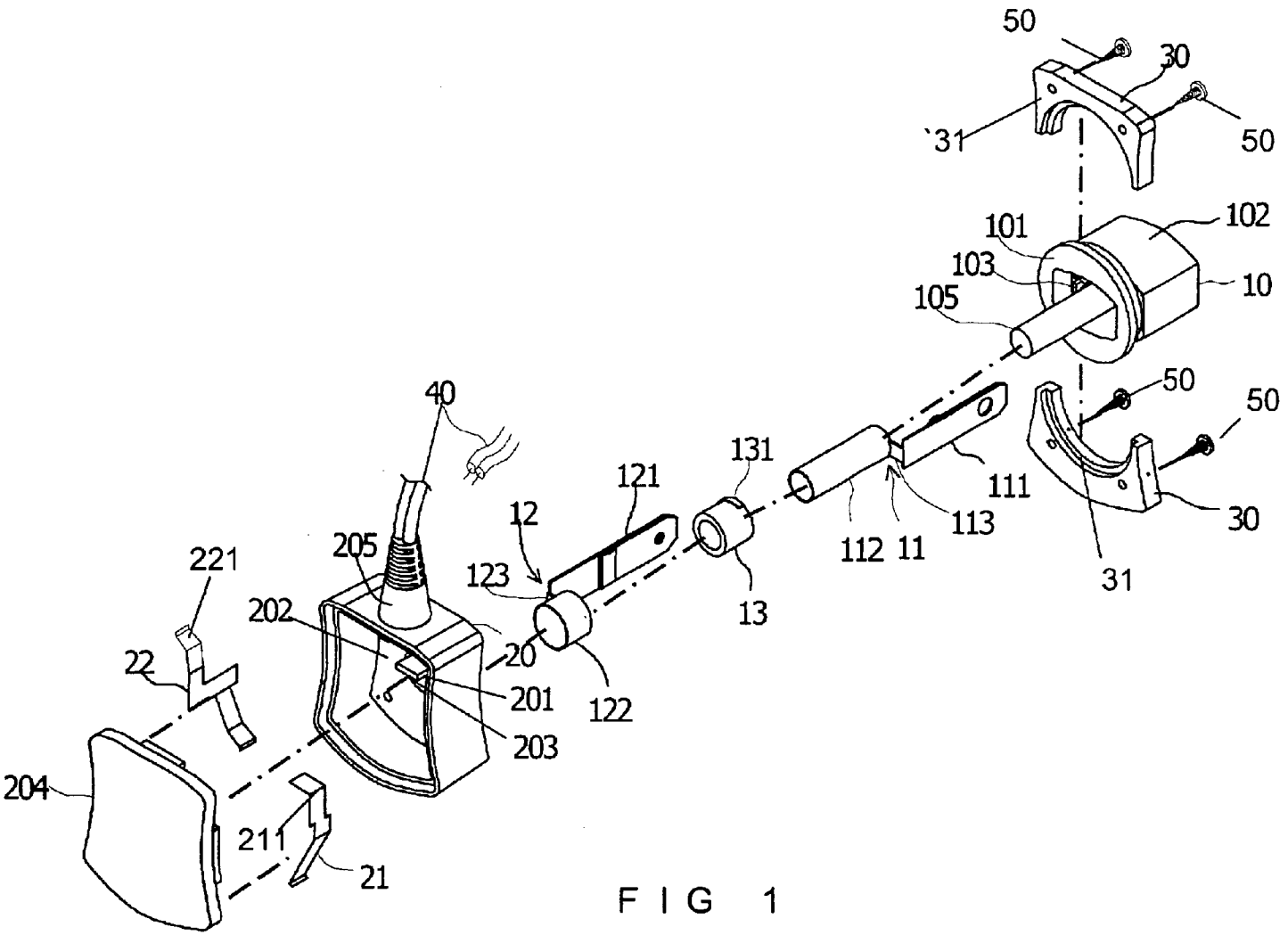
FIG. 1 is an exploded perspective view of an all-directional electric connector according to a first embodiment of the present invention.
Figure 2:
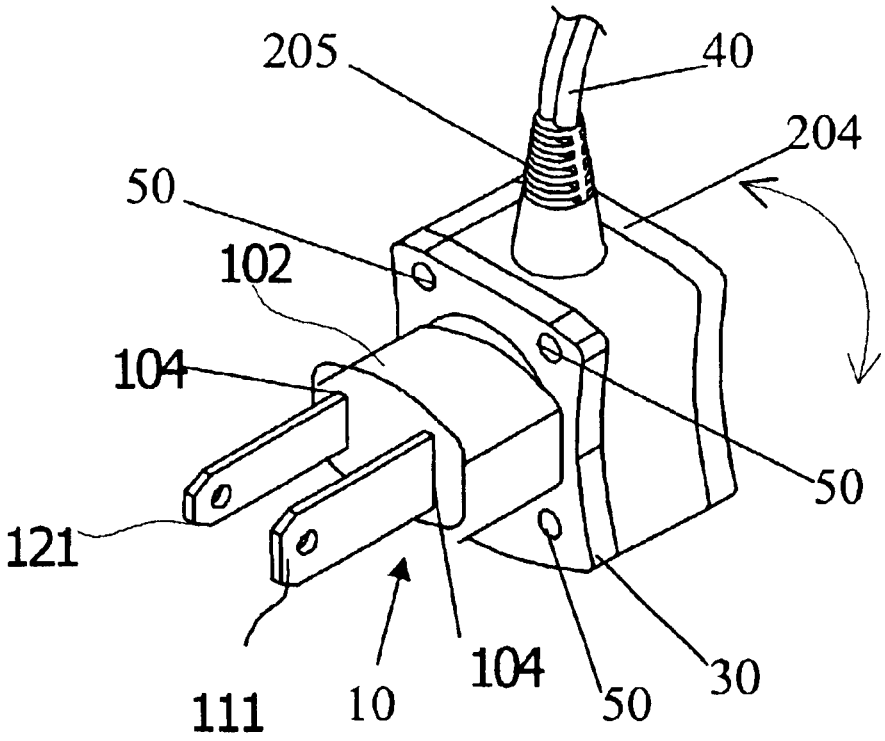
FIG. 2 is an assembled perspective view of FIG. 1.

The first part mainly includes a first casing 10, and a pair of conductive terminals, namely, first terminal 11 and second terminal 12. A front end of the first casing 10 is formed into a round plate 101, and a hollow space defined by the first casing 10 forms a terminal chamber 102 behind the round plate 101. A cylindrical bar 105 perpendicularly extends from a rear wall of the terminal chamber 102 to project from a central hole of the round plate 101. The terminal chamber 102 is internally provided with two guiding channels 103, via which first and second pins 111, 121 at rear ends of the first and the second terminal 11, 12, respectively,. are guided to project from two holes 104 provided on the rear wall of the terminal chamber 102, as shown in FIG. 2, so that the two pins 111, 121 may be plugged in a wall-mount electric receptacle to obtain a power supply.

A front end of the first conductive terminal 11 is a first cylindrical tube 112, which is eccentrically connected at a rear end to the first pin 111 via a first connecting section 113.

A front end of the second conductive terminal 12 is a second cylindrical tube 122 eccentrically connected at a rear end to the second pin 121 via a second connecting section 123.

The first terminal 11 is located in the first casing 10 with the first cylindrical tube 112 put around the cylindrical bar 105. A sleeve 13 having an inner diameter slightly larger than an outer diameter of the first cylindrical tube 112 is fitted around the first cylindrical tube 112 in a loose fit relation. In other words, a clearance between the sleeve 13 and the cylindrical bar 105 is large enough for fitting the first cylindrical tube 112 of the first terminal 11 therein. The sleeve 13 has an overall length smaller than that of the first cylindrical tube 112 and that of the cylindrical bar 105, and is provided at a rear end with a flange 131, as can be clearly seen from FIG. 3. The flange 131 is used to separate the first connecting section 113 from the second connecting section 123.

The second terminal 12 is located in the terminal chamber 102 with the second cylindrical tube 122 fitted around the sleeve 13.

Figure 4:
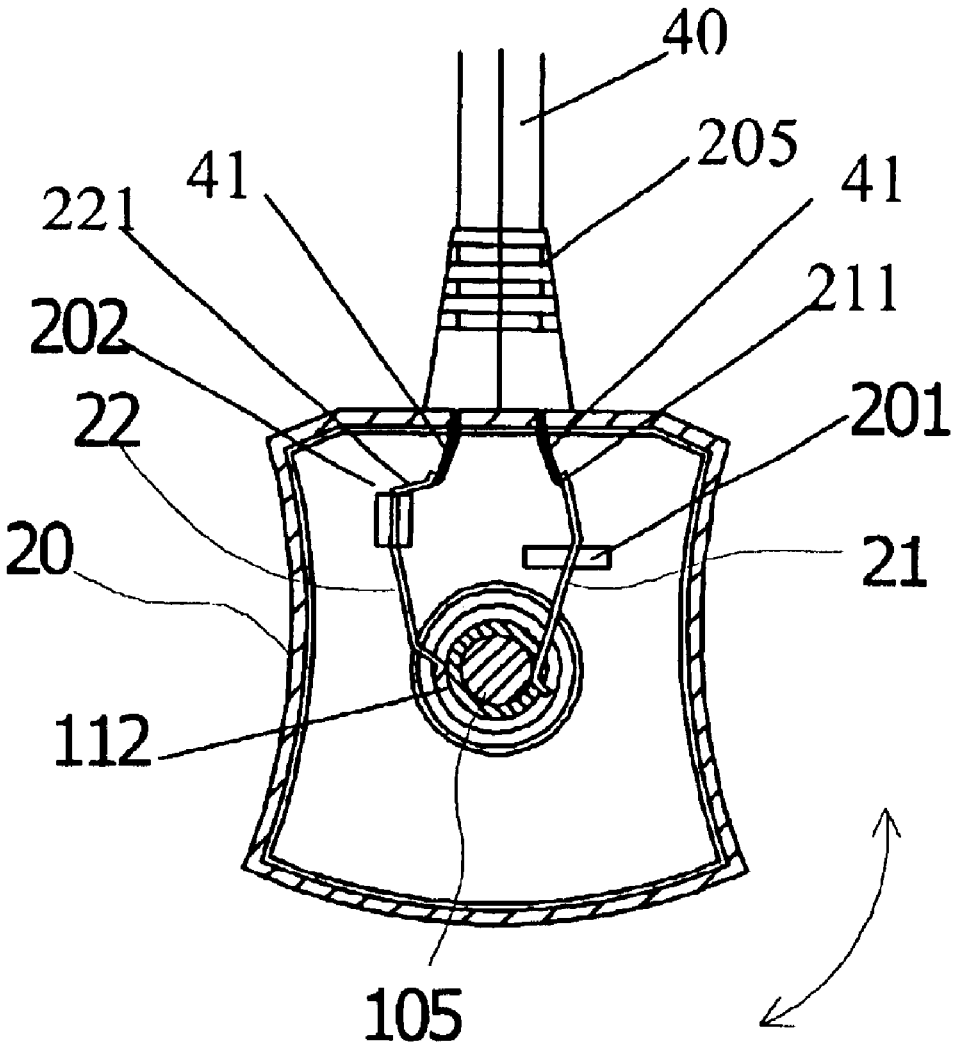
FIG. 4 is a sectional view taken along line 4—4 of FIG. 3.
Figure 5:
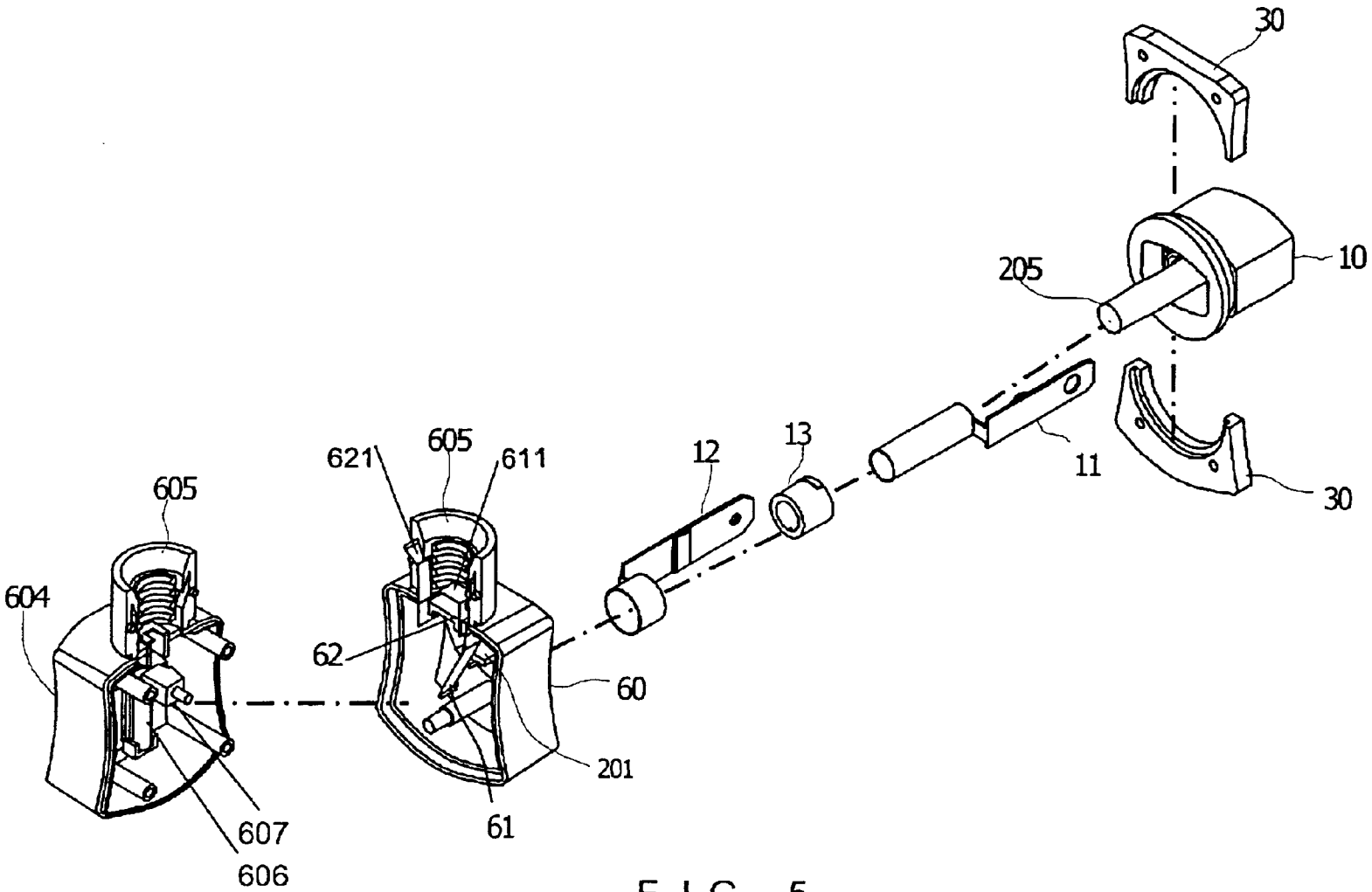
FIG. 5 is an exploded perspective view of an all-directional electric connector according to a second embodiment of the present invention.
Figure 6:
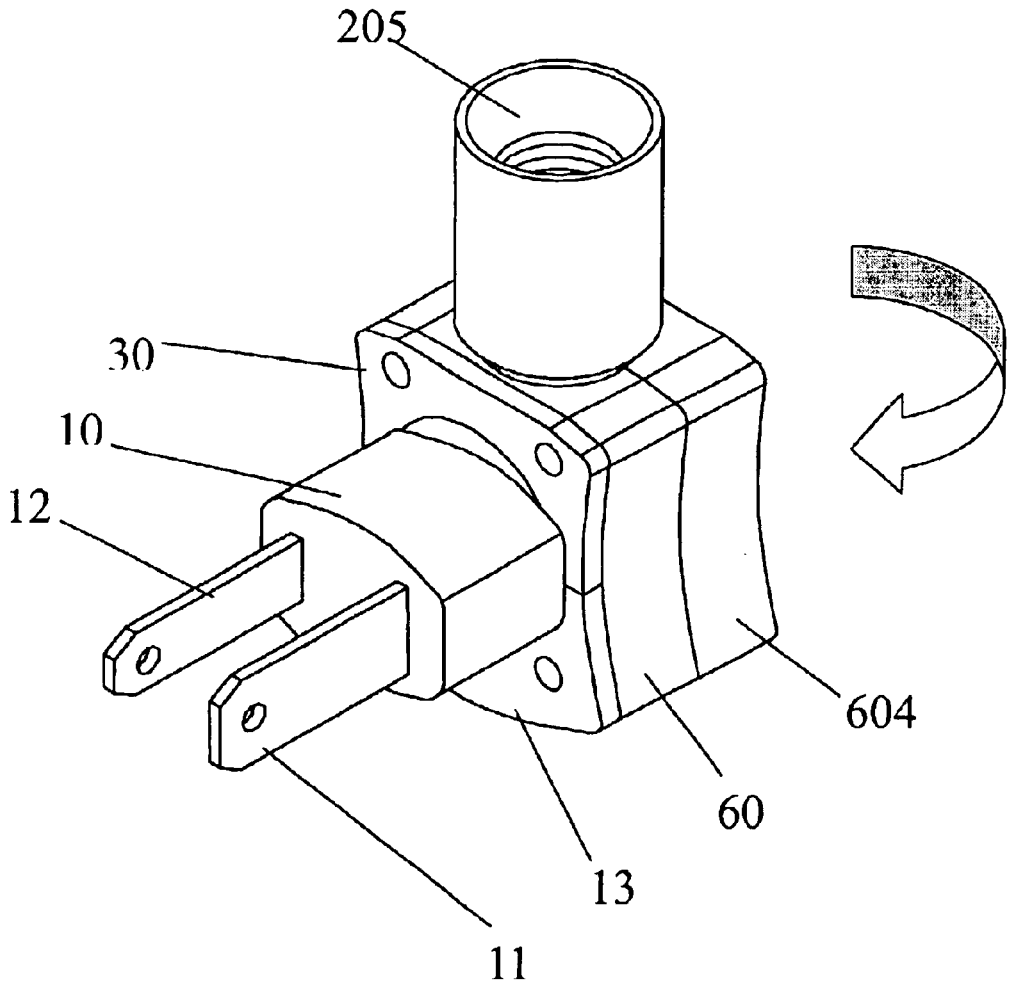
FIG. 6 is an assembled perspective view of FIG. 5.

The second part mainly includes a second casing 20 and a pair of conductive leaf springs, namely, a first leaf spring 21 and a second leaf spring 22. The second casing is provided on a rear wall with a round hole 203, via which the cylindrical bar 105 on the first casing 10 and the sleeve 13 are extended into the second casing 20. First and second leaf spring holders 201 and 202 are separately provided in the second casing 20 at two sides of the round hole 203 for locating the first and the second leaf spring 21, 22 in place in the second casing 20, so that the first and the second leaf spring 21, 22 always have an end in contact with the first and the second cylindrical tube 112, 122, respectively, and another end connected to two metal conductors 41 of a power cord 40 connected to the second casing 20, as shown in FIG. 4.

A front open end of the second casing 20 is closed with a sealing panel 204 snap-fitted or screwed thereto, so that the cylindrical bar 105 and the sleeve 13 extended into the second casing 20 via the round hole 203 are enclosed in the second casing 20 without being seen from outside of the second casing 20.

The second casing 20 is provided at a predetermined position with a power cord guide 205, via which a power cord 40 is extended into the second casing 20 with two metal conductors 41 of the power cord 40 connected or welded to two contacts 211 and 221 separately provided at an end of the first and the second leaf spring 21, 22.

Figure 3:
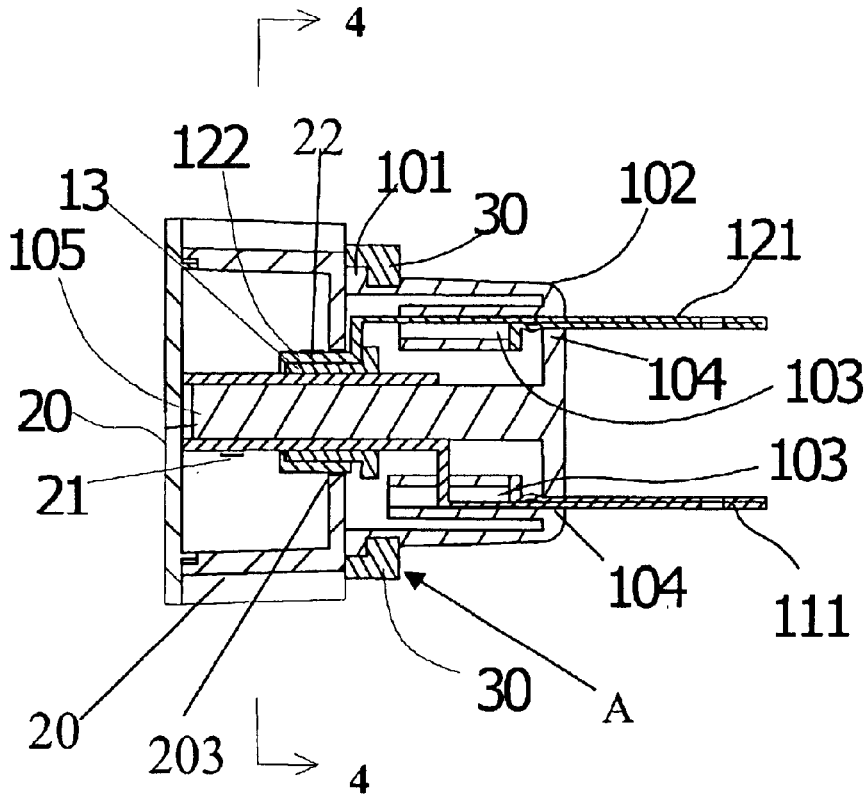
FIG. 3 is a sectioned side view of FIG. 2.
Figure 3A:
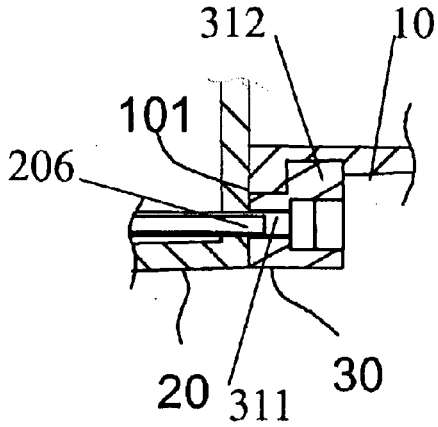
FIG. 3A is a fragmentary, enlarged view of the encircled area "A" of FIG. 3.

Two symmetrical locating plates 30 together defining a round opening 31 between them are screwed to the rear wall of the second casing 20 with screws 50. Please refer to FIGS. 3 and 3A. The round opening 31 has a diametrically expanded front bore 311, and a diametrically reduced rear bore 312. The front bore 311 is diametrically larger than the round plate 101 at the front end of the first casing 10, and the rear bore 312 is diametrically smaller than the round plate 101. The second casing 20 is externally provided on the rear wall with a recess that is diametrically slightly larger than the round plate 101. When the first casing 10 is connected to a rear end of the second casing 20 with the round plate 101 seated in the recess on the rearwall of the second casing 20, the two locating plates 30 may be screwed to the rear wall of the second casing 20 with screws 50 to confine the round plate 101 to a space between the rear wall of the second casing 20 and the front bore 311 of the round opening 31 while allows the round plate 101 to freely rotate therein. With these arrangements, the second casing 20 may be freely rotated about the cylindrical bar 105 relative to the first casing 10.

The first and second leaf springs 21, 22 are in elastic contact with front portions of the first and the second cylindrical tubes 112, 122, respectively, extended into the second casing 20, so as to normally press against the two cylindrical tubes 112, 122.

When the second casing 20 is rotated to any angular position relative to the first casing 10, as indicated by the arrow in FIG. 4, the two leaf springs 21, 22 are always kept in stable contact with the cylindrical tubes 112, 122, respectively. Therefore, even the two pins 111, 121 in the first casing 10 are fixedly plugged in a wall-mount electric receptacle (not shown), the power cord 40 may still be extended toward any desired direction by turning the second casing 20 relative to the first casing 10.

When the power cord 40 extended from the second casing 20 is undesirably twisted, an acting force is generated by the twisted power cord 40 on the second casing 20, causing the latter to automatically turn relative to the first casing 10, which is fixedly plugged in a wall-mount electric receptacle, until the power cord 40 is returned to a straightly extended position.

The second casing 20 may be differently designed depending on different applications of the electric connector. In FIGS. 5 to 8, there is illustrated an all-directional electric connector according to a second embodiment of the present invention for use as a mini dim light. The all-directional electric connector in the second embodiment includes a first casing 10 that is structurally similar to the first casing 10 in the first embodiment, and a second casing 60 having a lamp holder 605 provided at a predetermined position to replace the power cord guide 205. A first and a second leaf spring 61, 62 are located in the second casing 60 with contacts 611, 621 formed at one end thereof extended into the lamp holder 605.

Figure 7:
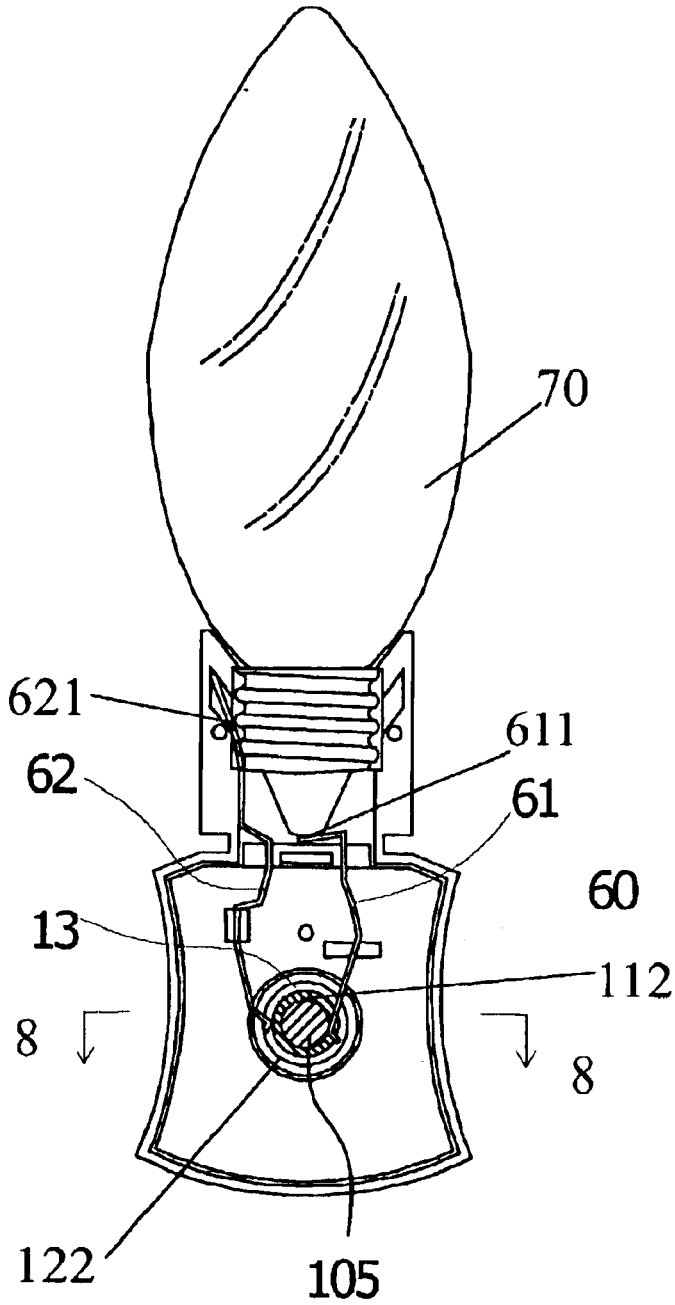
FIG. 7 is a sectional view of FIG. 6 with a lamp bulb mounted thereto.
Figure 8:
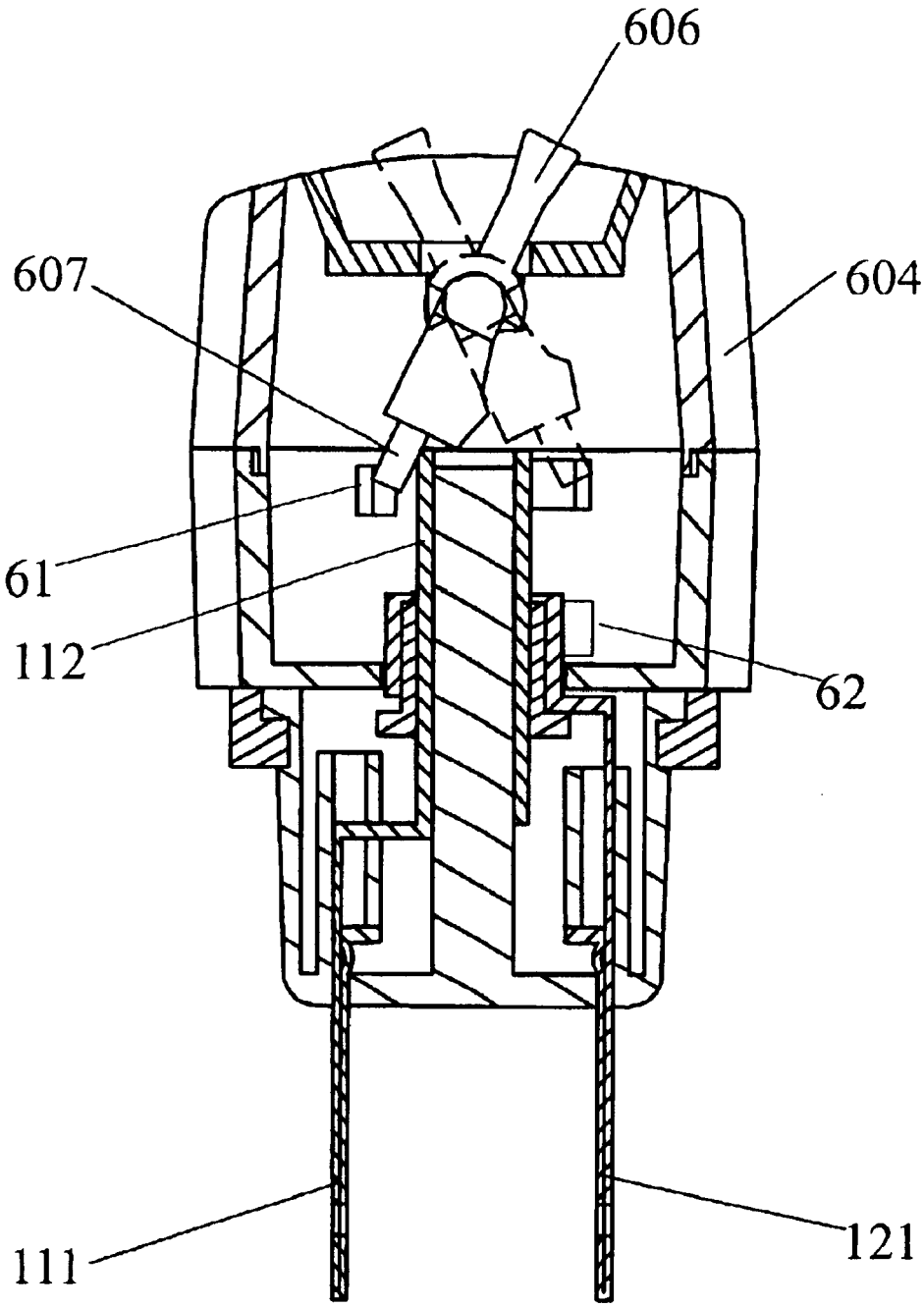
FIG. 8 is a sectional view taken along line 8—8 of FIG. 7.

As can be seen from FIG. 7, the two leaf springs 61, 62 are respectively in elastic contact with front portions of the cylindrical tubes 112, 122 of the first and the second conductive terminals 11, 12 extended into the second casing 60. When a lamp bulb 70 is mounted on the lamp holder 605, the lamp bulb 70 may be freely turned along with the second casing 60 about the cylindrical bar 105 to any desired direction relative to the wall-mount electric receptacle and the first casing 10 fixedly plugged in the receptacle, as indicated by the arrow in FIG. 6.

In the second embodiment, the second casing 60 includes two complementary halves, one of which that is located at a front end of the second casing 60 is a sealing half 604. As car be seen from FIG. 8, there is a mechanical-type switch provided on the sealing half 604. The mechanical-type switch includes a control lever 606 having a front end exposed from the sealing half 604, and a push bar 607 rearward extended from the control lever 606 toward the first leaf spring 61. When the control lever 606 is pushed to a first position as indicated by the solid lines in FIG. 8, the push bar 607 is shifted to move the first leaf spring 61 away from the first cylindrical tube 112 of the first terminal 11 and thereby disconnect the lamp bulb 70 from the power supply. When the control lever 606 is pushed to a second position as indicated by the broken lines in FIG. 8, the push bar 607 is shifted to separate from the first leaf spring 61, allowing the latter to return to a position in contact with the first cylindrical tube 112 of the first terminal 11 and thereby electrically connect the lamp bulb 70 to the power supply.

Figure 9:
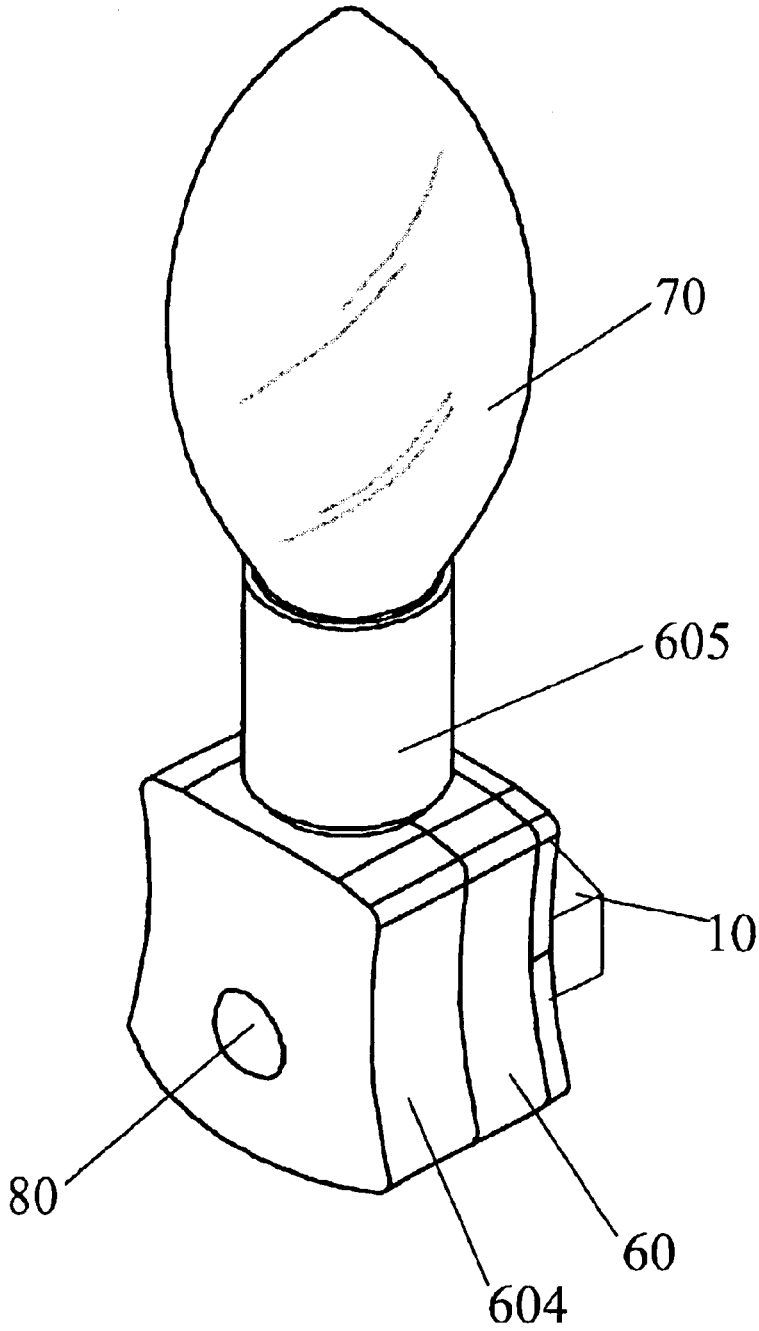
FIG. 9 is an assembled perspective view of an all-directional electric connector according to a third embodiment of the present invention.

Alternatively, in a third embodiment of the present invention, the mechanical-type switch is replaced with a light-sensitive switch 80 to control the electrical connection of the leaf springs to the conductive terminals, as shown in FIG. 9. In this case, the light-sensitive switch 80 must be provided at a front wall (that is, the sealing half 604) of the second casing 60 to detect an intensity of light projected from a light source to the front wall. When the intensity of the light projected to the front wall of the second casing 60 is higher than a value preset for the light-sensitive switch 80, the first leaf spring 61 is disconnected from the first cylindrical tube 112. And, when the intensity of the light projected onto the front wall of the second casing 60 is lower than a value preset for the light-sensitive switch 80, the first leaf spring 61 is electrically connected to the first cylindrical tube 112.

Figure 10:
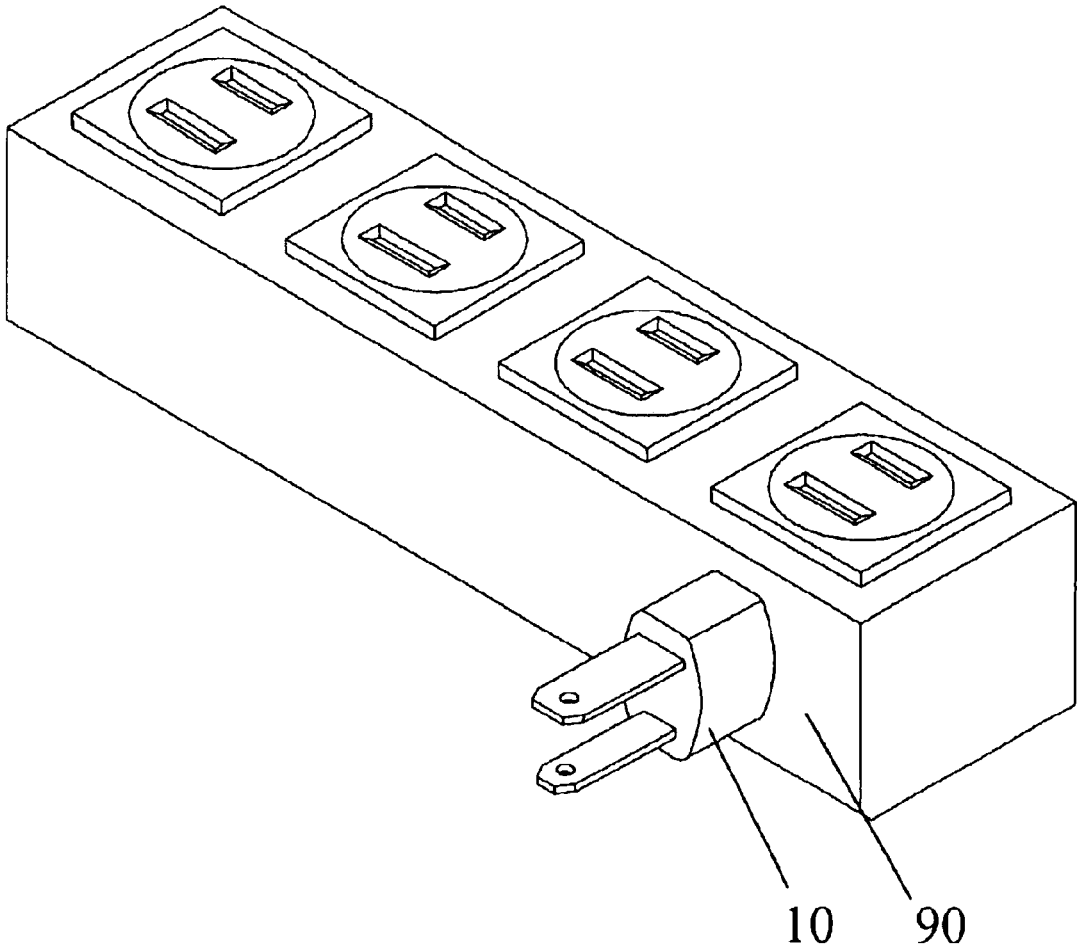
FIG. 10 is an assembled perspective view of an all-directional electric connector according to a fourth embodiment of the present invention.

FIG. 10 shows an all-directional electric connector according to a fourth embodiment of the present invention. In this fourth embodiment, the second casing is in the form of a receptacle 90. In this case, the two conductive leaf springs in the second casing are extended to form two electrodes in the receptacle 90, or to electrically connect to two electrodes in the receptacle 90.

With the all-directional electric connector of the present invention, the second part thereof may be freely located at any angular position relative to the first part when the first part is plugged in a fixed wall receptacle. Therefore, a power cord connected to the second part may be adjusted toward a suitable direction to avoid undesirable twisting.

What is claimed is:

1. An all-directional electric connector, comprising a first part for fixedly connecting to a power source by plugging in a wall-mount receptacle, and a second part rotatably connected to a front side of said first part for electrically connecting to an electric appliance;

said first part including a first casing having a cylindrical bar projected from a front open end of said first casing, and at least a first and a second conductive terminal; said first conductive terminal including a first pin having a rear end rearward projected from the rear wall of said first casing and a first cylindrical tube eccentrically extended from a front end of said first pin to enclose said cylindrical bar; said second conductive terminal including a second pin having a rear end rearward projected from the rear wall of said first casing and a second cylindrical tube eccentrically extended from a front end of said second pin to enclose a sleeve put on said first cylindrical tube at a predetermined position; said sleeve having an overall length smaller than that of said cylindrical bar, enabling a front portion of said first cylindrical tube to expose from said sleeve; and said first and said second pin being adapted to plug in said wall receptacle; and said second part including a second casing, and a first and a second conductive leaf spring provided in said second casing to space from each other; said first and said second leaf spring being contacted at one end with front portions of said first and said second cylindrical tube, respectively, and provided at the other end with two contacts;

said second casing being rotatable about said cylindrical bar, a front portion of which exposed from said first casing is extended into said second casing, to locate at any angular position relative to said first casing while said first and said second leaf spring in said second casing are kept in contact with the front portions of said first and said second cylindrical tube, respectively, so that power may be supplied from said wall receptacle via said first and said second terminals to contacts on said first and said second leaf spring even when the second casing is rotated.

2. The all-directional electric connector as claimed in claim 1, wherein said sleeve is provided at a rear end with a flange for separating said second cylindrical tube from said first cylindrical tube.

3. The all-directional electric connector as claimed in claim 1, wherein said cylindrical bar is perpendicularly extended from a rear wall of said first casing into said second casing.

4. The all-directional electric connector as claimed in claim 3, wherein said first casing has a front end formed into a round plate, via a central opening of which said cylindrical bar is forward extended into said second casing; said round plate being circumferentially rotatably set in a space between a rear wall of said second casing and a diametrically expanded front bore defined between two locating halves fixed to the rear wall of said second casing, such that said second casing is rotatable about said cylindrical bar relative to said first casing.

5. The all-directional electric connector as claimed in claim 1, wherein said second casing is provided at a predetermined position with a lamp holder, and said contacts provided on one end of said first and said second leaf spring are located in said lamp holder for electrically contacting with a lamp bulb mounted in said lamp holder.

6. The all-directional electric connector as claimed in claim 5, wherein said second casing is provided at a predetermined position with a switch, and one of said two leaf springs is electrically connected to or disconnected from a corresponding one of said two conductive terminals through control of said switch.

7. The all-directional electric connector as claimed in claim 6, wherein said switch is a mechanical-type switch including a control lever having an end exposed from said second casing, and a push bar extended from said control lever toward said leaf spring to be controlled; said control lever being adapted to move to a first position in which said push bar is in contact with said leaf spring to be controlled to disconnect said leaf spring from said corresponding conductive terminal, and to a second position in which said push bar is separated from said leaf spring to be controlled for the latter to contact with said corresponding conductive terminal.

8. The all-directional electric connector as claimed in claim 6, wherein said switch is a light-sensitive switch; said leaf spring to be controlled being caused to contact with said corresponding conductive terminal when an external light source has an intensity lower than a value preset for said light-sensitive switch, and said leaf spring to be controlled being caused to disconnect from said corresponding conductive terminal when said external light source has an intensity higher than said value preset for said light-sensitive switch.

9. The all-directional electric connector as claimed in claim 1, wherein said two contacts provided at one end of said first and said second leaf spring in said second casing are separately connected to two metal conductors of a power cord.

10. The all-directional electric connector as claimed in claim 1, wherein said second casing is in the form of an electric receptacle, and two contacts on one end of said first and said second leaf spring are electrically connected to two metal electrodes provided in said electric receptacle.

* * * * *